United States Patent [19]

King

[11] 4,033,147

[45] July 5, 1977

[54] CIRCULAR KNITTING MACHINE WITH PIVOTALLY MOUNTED ACCESS PLATFORM

[75] Inventor: Herbert Ray King, Spartanburg, S.C.

[73] Assignee: Milliken Research Corporation, Spartanburg, S.C.

[22] Filed: May 5, 1975

[21] Appl. No.: 574,502

[52] U.S. Cl. ..... 66/8; 108/50; 312/235 R; 297/217

[51] Int. Cl.² ..... D04B 9/00

[58] Field of Search ..... 108/50, 48; 297/331, 297/334, 335, 217, 142; 66/8, 147, 151, 149 R, 1 R, 60 R, 64, 60 H; 182/222, 91; 312/335, 228, 235 R; 139/13, 1 R, 304

[56] References Cited

UNITED STATES PATENTS

| | | | |
|---|---|---|---|
| 484,719 | 10/1892 | Jackson | 297/142 X |
| 553,108 | 1/1896 | Davison | 297/142 |
| 682,297 | 9/1901 | Tucker | 297/142 |
| 1,344,940 | 6/1920 | Gavin | 297/142 |
| 1,696,312 | 12/1928 | Lethander | 297/142 |
| 1,712,126 | 5/1929 | Taylor | 108/50 |
| 2,565,695 | 8/1951 | Lynn | 297/334 X |
| 2,570,865 | 10/1951 | Sabo | 297/217 X |
| 2,636,549 | 4/1953 | Geller | 108/48 X |
| 2,650,145 | 8/1953 | Sieminski | 108/48 |
| 2,767,032 | 10/1956 | Mitchell | 182/222 X |
| 2,784,004 | 3/1957 | Hamrick | 108/48 X |
| 2,858,056 | 10/1958 | Ownby | 297/217 X |
| 3,073,648 | 1/1963 | Johnson | 297/142 |
| 3,590,599 | 7/1971 | Ricart | 66/8 |
| 3,696,762 | 10/1972 | Holdham | 108/48 X |
| 3,779,041 | 12/1973 | Gati | 66/147 X |
| 3,797,607 | 3/1974 | Gargasz | 182/222 X |
| 3,855,822 | 12/1974 | Lee | 66/151 X |
| 3,959,991 | 6/1976 | Brown | 66/8 |
| 3,959,992 | 6/1976 | Eschenbach | 66/8 |

FOREIGN PATENTS OR APPLICATIONS

| | | | |
|---|---|---|---|
| 838,914 | 3/1939 | France | 108/48 |

*Primary Examiner*—Louis K. Rimrodt
*Assistant Examiner*—A. M. Falik
*Attorney, Agent, or Firm*—H. William Petry; Earle R. Marden

[57] ABSTRACT

A circular knitting machine having a step attached to the machine which is accessible when the machine is in operation but can be moved out of the way when the knitting guard is opened to gain access to the interior of the machine.

1 Claim, 6 Drawing Figures

CIRCULAR KNITTING MACHINE WITH PIVOTALLY MOUNTED ACCESS PLATFORM

The object of the invention is to provide steps on a circular knitting machine for use by an operator when the machine is in use but which are readily moved out of the way when it is necessary to gain entrance to the interior of the machine.

Other objects and advantages of the invention will become clearly apparent as the specification proceeds to describe the invention with reference to the accompanying drawings, in which.

Figure 1:
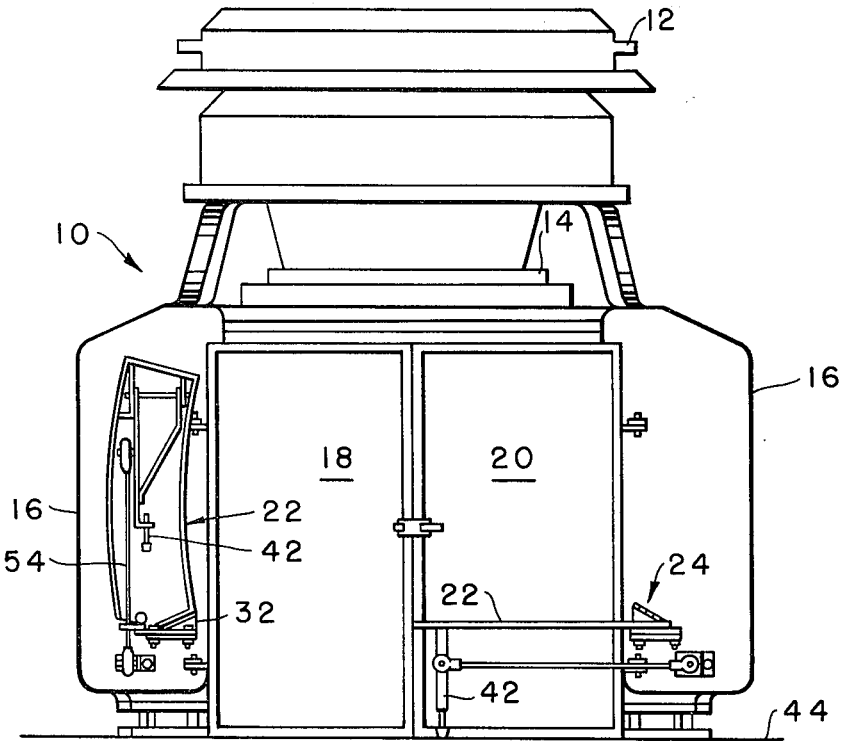
FIG. 1 is a schematic front elevation view of a circular knitting machine which employs a step for use by the machine operator.

Looking now to FIG. 1, the reference numeral 10 represents a conventional circular knitting machine which is supplied with a plurality of yarns from an off-side creel (not shown). The yarn is supplied through the yarn guide ring 12 to the rotating needle cylinder 14 whereat it is knit into a tube of fabric and taken up on a take-up roll located inside the machine. The knitting machine employs a plurality of frame members 16 between which are hinged a pair of screen guard doors 18 and 20 to prevent access to the interior of the machine during operation.

Also hinged to each of the frame members 16 is a cantilevered platform or step 22 to allow an operator to gain access to the upper regions of the machine 10. The hinge construction 24 for the platform consists of a base plate 26 rigidly connected to the frame member 16, a hinge support plate 28 secured by suitable screws 30 to the support plate 26, a fixed hinge member 32 welded or otherwise secured to and perpendicular to the support plate 28 and a second hinge member 34 welded or otherwise secured to the platform 22. The actual hinge portions 36 of the hinge are interlocked by a hinge pin 38 to form the actual pivot point. The hinge is mounted at an acute angle A to the support plate 28 so that the platform 22 will clear the doors 18 and 20 when the platform is raised to the position shown in FIGS. 1 and 2. The hinge is also mounted, in the horizontal plane, at an acute angle B to the frame members 16 to allow the platform 22 to swing up close to the frame members without having the outer free end 40 of the platform 22 projecting outwardly from the machine 10.

Pivotally mounted to the bottom of each of the platforms is a leg 42 which contacts the floor 44, as shown in FIG. 1, when the platform 22 is in the down position. The leg 42 is pivotally mounted by a shaft 46 secured in support members 48 and 50 by cotter pins 52. To guide the upward and downward movement of the leg 42 and to serve as a brace in the down position, a lever arm 54 is pivotally connected to the leg 42 at 56 at one end and pivotally secured to the bracket 58 at the other end. The bracket 58 is rigidly mounted to the frame by suitable screws 60.

Figure 3:
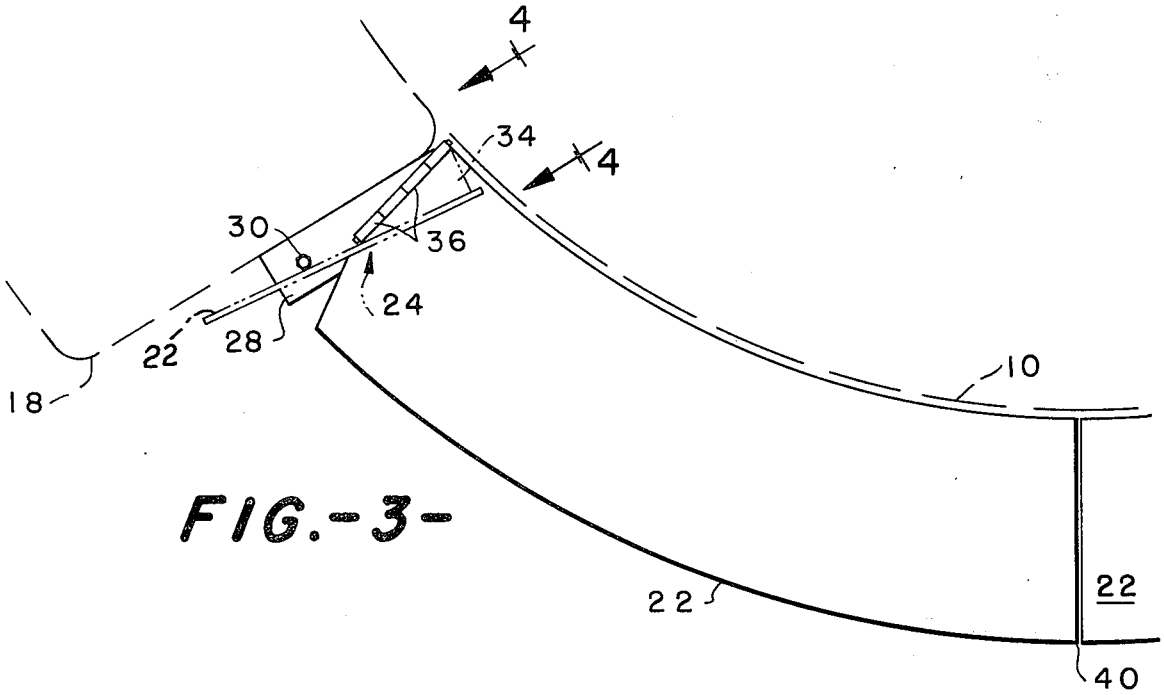
FIG. 3 is a top schematic view of the left hand step shown in FIG. 1 when in the down position.
Figure 2:
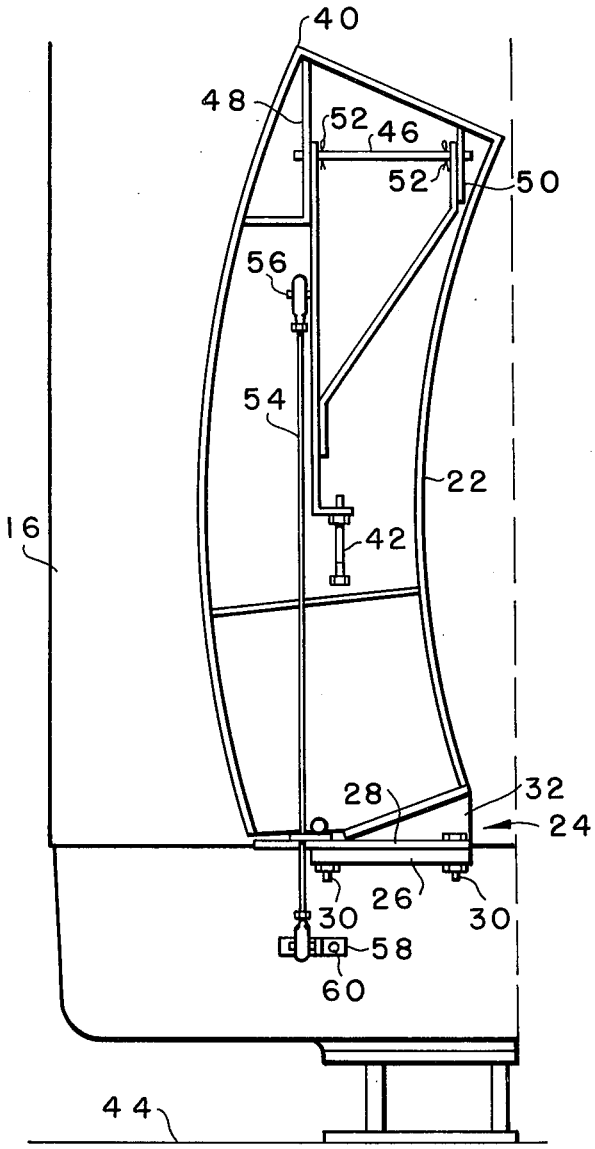
FIG. 2 is a blown-up front view of the left hand step shown in FIG. 1.
Figure 4:
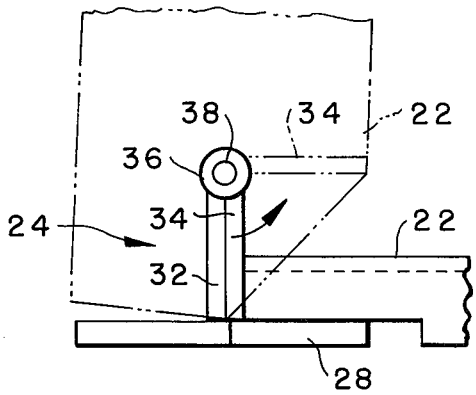
FIG. 4 is a partial view taken on line 4—4 of FIG. 3 showing the hinge and step connection.
Figure 5:
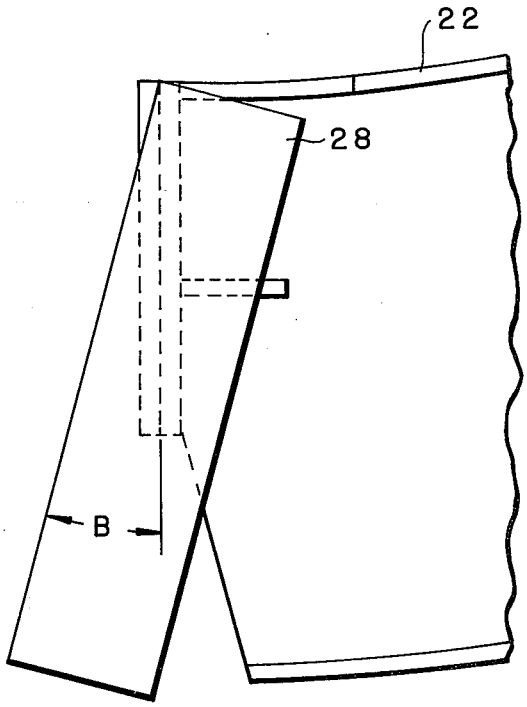
FIG. 5 is a bottom view of FIG. 4.
Figure 6:
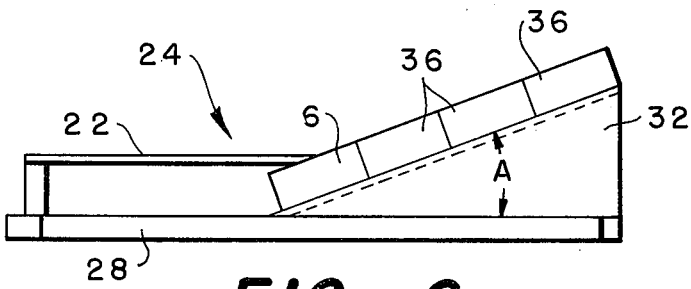
FIG. 6 is a left hand elevation view of FIG. 5.

In normal operation when the knitting machine 10 is producing fabric, the platform 22 will be in the down positon, as represented by the right hand platform in FIG. 1 and in FIGS. 3–5. When it is desired to gain access to the interior of the machine, the platforms 22 have to be moved out of the way in order to open the doors 18 and 20. To move the platforms 22, they are pivoted upwardly and outwardly about the hinge 24 to rotate the hinge member 34 perpendicular to the hinge member 32, as shown in dotted lines in FIG. 3 and FIG. 4, to place the platform 22 closely adjacent its associated frame member as shown in FIGS. 1 and 2. At the same time, legs 42 will be pivoted to a nested position inside the bottom of its respective platform 22.

It should be noted that the angle B between the hinge 24 and the frame member is employed so that the doors 18 and 20 can be fully opened and not be restricted by the platform in its upward nested position.

It can be seen that a circular knitting machine has been provided with a platform for use by an operation which is accessible for use and at the same time can be readily moved to an inoperative position when it is desired to gain access to the interior of the machine.

Although the preferred embodiment of the invention has been described, it is contemplated that changes may be made without departing from the scope or spirit of the invention and it is desired that the invention be limited only by the claims.

That which is claimed is:

1. A circular knitting machine having a frame and a means to produce a circular knitted fabric comprising: means mounting a platform to allowing said platform to be moved to positions substantially both perpendicular or parallel to the vertical centerline of said machine, said means including hinge means to allow said platform to be pivoted about the hinge both outwardly and vertically upward adjacent said frame, said hinge means being mounted at an acute angle to said platform and to said frame.

* * * * *